United States Patent [19]

Oplatka

[11] 4,291,537

[45] Sep. 29, 1981

[54] THERMAL ENERGY STORAGE FOR COVERING PEAK LOADS

[75] Inventor: George Oplatka, Zürich, Switzerland

[73] Assignee: BBC Brown, Boveri & Co., Ltd., Baden, Switzerland

[21] Appl. No.: 35,598

[22] Filed: May 3, 1979

[30] Foreign Application Priority Data

May 9, 1978 [CH] Switzerland ..... 5041/78
Feb. 1, 1979 [CH] Switzerland ..... 963/79

[51] Int. Cl.[3] ..... F01K 3/00

[52] U.S. Cl. ..... 60/652; 60/659; 60/677

[58] Field of Search ..... 60/652, 659, 679, 677

[56] References Cited

U.S. PATENT DOCUMENTS 3,129,564 4/1964 Brunner ..... 60/659
3,890,789 6/1975 Beckmann et al. ..... 60/659
4,129,004 12/1978 Thelen et al. ..... 60/652
4,130,992 12/1978 Bitterlich et al. ..... 60/659 X
4,164,848 8/1979 Gilli et al. ..... 60/652

*Primary Examiner*—Allen M. Ostrager
*Assistant Examiner*—Stephen F. Husar
*Attorney, Agent, or Firm*—Burns, Doane, Swecker & Mathis

[57] ABSTRACT

To cover peak loads an auxiliary circuit having a water store which can be charged from the main circuit is connected to the main circuit of a thermal power station. The stored energy carrier is expanded by throttling, whereupon the vaporous part performs work in a peak-load turbine or in part of the main turbine, which is designed for this purpose, while the unvaporized part is returned to the main circuit in such a way that the low-pressure bleed points of the main turbine are relieved and the output of the main turbine is thus increased. The water store is preferably fed with condensate from the reheater.

6 Claims, 3 Drawing Figures

THERMAL ENERGY STORAGE FOR COVERING PEAK LOADS

BACKGROUND AND SUMMARY OF THE PRESENT INVENTION

The present invention relates generally to a process for evening out load fluctuation in an electricity supply network. The invention also relates to equipment for carrying out the process.

Thermal energy storage in thermal powr plants is an excellent means for dealing with medium-term fluctuations in the energy demand of the consuming network.

Processes for evening out load fluctuations and equipment required for carrying out the processes are known (Article by Gilly and Beckmann, Spitzenlastdeckung durch thermische Energiespeicherung [Covering Peak Loads by Thermal Energy Storage], VDI-Berichte No. 236, 1975, page 125 to 131). In these known processes, the water which leaves the expansion vessel and is collected in an auxiliary storage vessel is returned to the main store during charging and is thus heated up by the charging steam taken from the main circuit. It is mentioned in the same publication, however, that in principle, the store can be charged from the feedwater circuit. This process which utilizes a separate peak-load turbine, is alleged to have the advantage that the peak-load turbine can be located separately and that, if the store is not charged from the feedwater circuit, the main circuit is almost free from intervention. However, the utilization of the storage capacity is relatively poor in these processes, unless the expansion is carried out in several stages, which requires complicated circuit arrangements.

Overloading the turbine of the power station is regarded as a further possible way of covering peak loads. This can be effected, for example, in such a way that a displacement store completely filled with water is arranged parallel to the feedwater heaters of the plant, which are heated by bled steam, the contents of the displacement store being fed to the steam generator when the load rises suddenly and steeply (Dubbles Taschenbuch fur den Maschinenbau [Handbook of Mechanical Engineering], volume 2, Springer-Verlag, 1961, page 452).

In this way, the bleed points of the turbine are relieved, enabling it to deliver a higher output. This increase in output is, however, limited.

A primary object of the present invention is to provide a process and equipment for carrying out the process, which exhibit the advantages of both the known possible methods of covering peak loads.

In a process of the type outlined above, this is achieved if that part of the stored medium which is not vaporized on expansion is returned in liquid form to the main circuit when the store is discharged and the steam bled from the main circuit to heat the low-pressure feed-heaters is throttled or shut off.

Equipment of the type initially set out is characterized by the fact that the expansion vessel is connected on the water side to the feedwater tank of the main circuit and that at least one condensate vessel, which on the downstream side leads into the low-pressure feed-heater installation of the main circuit, is provided for the condensate from the turbine.

The advantages of the invention are in particular that, with the store fully or partially charged, operation is rendered flexible and immediately adaptable, and a small or very large additional output is obtainable. The latter results from the simultaneous utilization of the liquid and vaporous part of the stored energy carrier.

BRIEF DESCRIPTION OF THE DRAWINGS

Preferred embodiments of the present invention are described with reference to the accompanying drawings wherein like members bear like reference numerals and wherein.

DETAILED DESCRIPTION OF THE PREFERRED EMBODIMENTS

Elements which are not necessary to understand the invention, such as, for example, the complete feed-heater line and the bleed points, heating the former, on the turbine as well as such items of equipment as the diverse control elements, isolation elements and switch-over elements, are not shown. The direction of flow of the working medium is marked by arrows.

Figure 1:
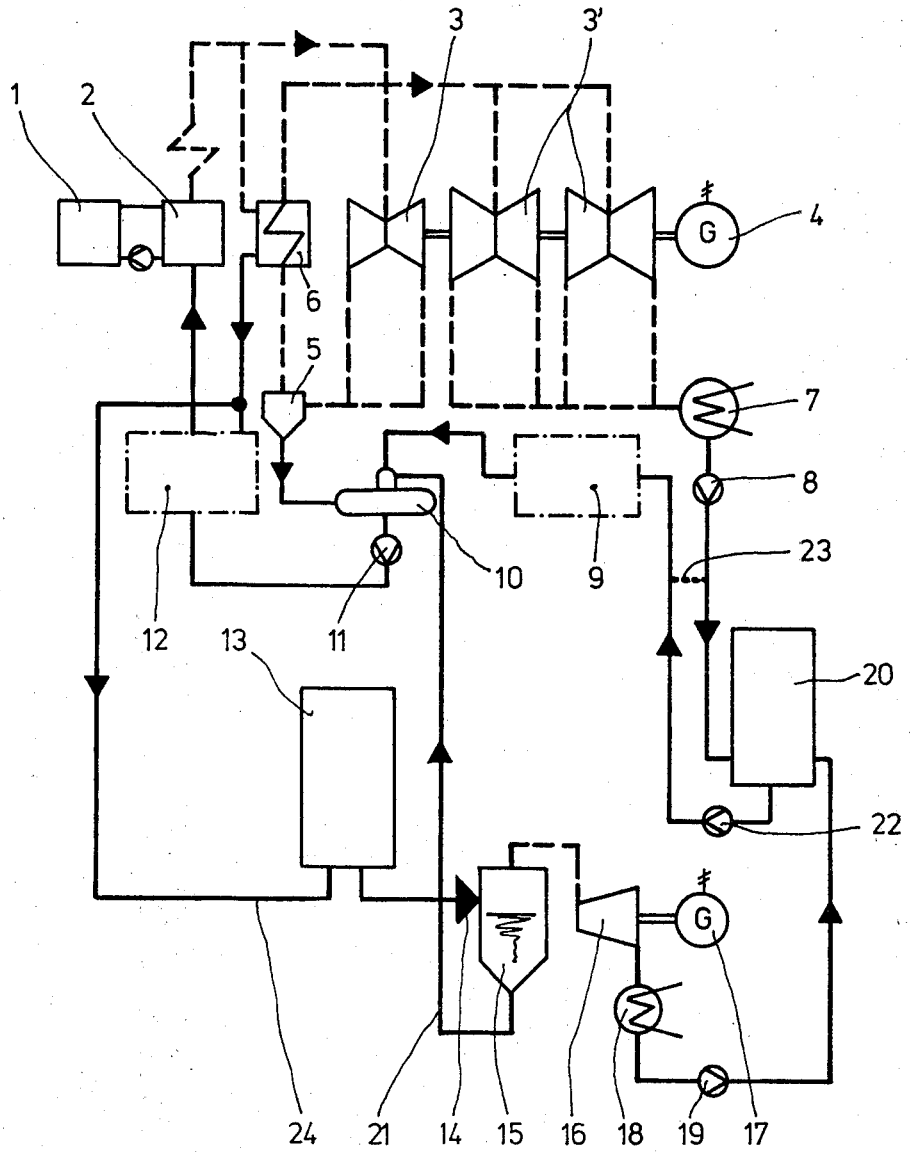
FIG. 1 is a schematic view of the circuit diagram of a thermal power station according to the invention.
Figure 3:
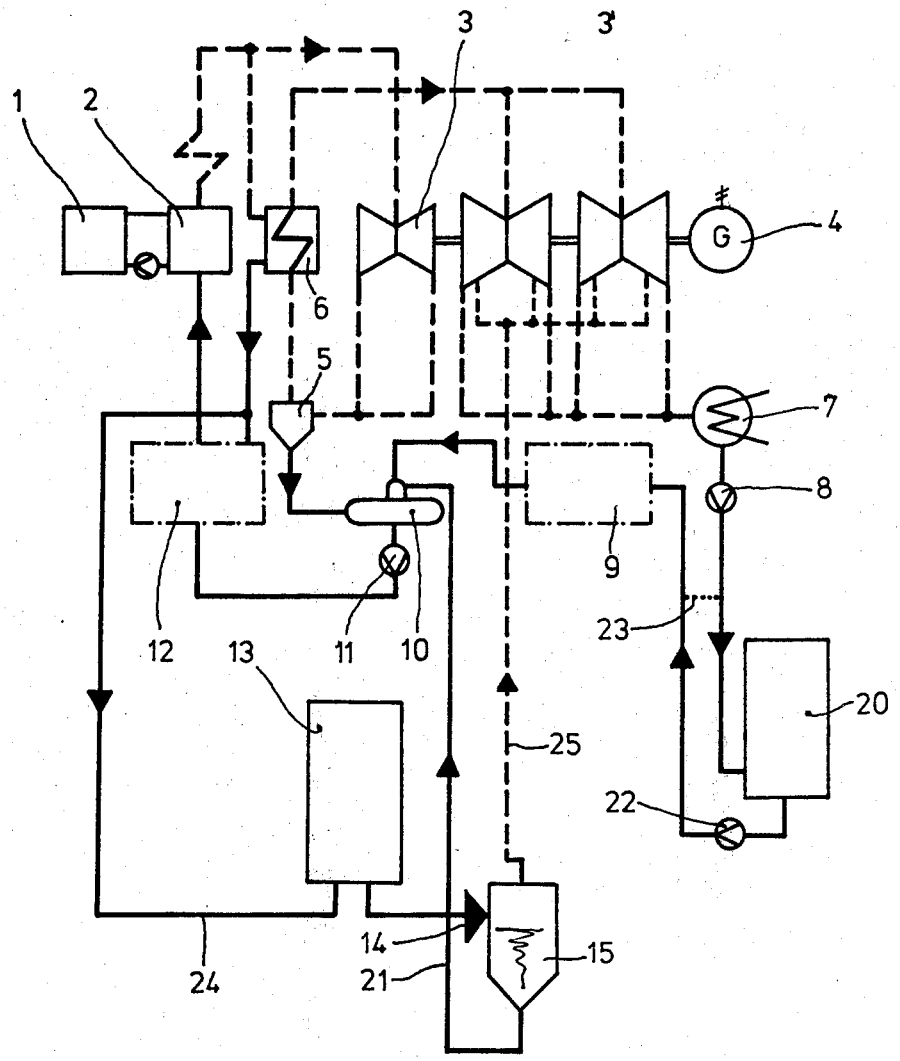
FIG. 3 is a schematic view of a modification of the thermal power plant according to FIG. 1.

With reference now to FIGS. 1 and 3, a nuclear power station has a pressurized water reactor 1, which delivers heat via a steam generator 2, so that the reactor is separated from a turbine circuit. A turboset consists of a double-flow high-pressure turbine 3 and two low-pressure parts 3' which are each double-flow. The turbine is coupled to a generator 4.

The steam, saturated steam in the present case, passes from the steam generator 2 into the high-pressure turbine 3 and from there into a water separator 5 in which moisture is removed. Subsequently, the steam flows through a reheater 6 heated by live steam and then passes into the low-pressure turbine 3' in which it is expanded down to the condenser pressure. The expanded steam is precipitated in the condenser 7 and the condensate is delivered by the condensate pump 8 through the feed-heater line which is shown in a simplified manner. Feedwater heating is carried out in several stages, first in the low-pressure feed-heaters 9 and in a mixing heater 10.

The mixing heater at the same time acts as feedwater tank and contains a deaerator which is not shown in detail. The feed pump 11 then returns the feedwater through the high-pressure feed-heaters 12 to the steam generator 2. The condensate from the reheater 6 is used as a heating aid in the high-pressure feed-heater line 12, and the condensate from the water separator 5 is discharged into the feedwater tank 10.

To this extent, a thermal power plant, designated in the following text as the main circuit, is known.

With reference now to the lower part of FIGS. 1 and 3, an auxiliary or peak circuit is substantially composed of a storage vessel 13, a throttling element 14, a expansion vessel 15 and a peak-load turbine 16 which drives a generator 17.

During peak operation, that is to say when discharging the store 13, steam generation takes place in the expansion vessel 15 with the aid of the throttling element 14, whereupon the steam expands while performing work in the turbine 16 and is then precipitated in a condenser 18. A condensate pump 19 delivers the water to a condensate vessel 20.

To this extent, auxiliary circuits and processes for operating them are known, the water collecting in the expansion vessel 15 being, as a rule, first delivered to an auxiliary storage vessel and, when this is fully charged, being returned from there via a charging system to the store.

According to the invention, the working medium which is not vaporized in the expansion vessel 15 is returned to the main circuit. This is effected via a line 21 which leads into the feedwater tank 10. Since during peak-load operation, this quantity of water contributes to feeding the steam generator 2 (and, consequently, the water and steam sides of the low-pressure feed-heaters 9 have to be shut off, and so that no condensate from the main circuit circulates through the feed-heaters), a condensate vessel 20 is designed in such a way that, for the duration of discharge, it can receive both the main condensate and the auxiliary condensate. At low load or during base-load operation (main circuit only), the feedwater is delivered by a cold low-pressure feed pump 22 from this vessel 20 to the feed-heater line. For base-load operation it would of course also be possible to provide a line 23 (shown dotted), through which the condensate pump 8 delivers the feedwater directly to the feed-heaters, by-passing the vessel 20.

To charge the store, the condensate from the reheater 6 is used as the working medium for the peak circuit and while the store is being charged this condensate is no longer passed to the high-pressure feed-heaters 12 but via line 24 to store 13. This is thermodynamically advantageous since no irreversible processes take place.

Figure 2:
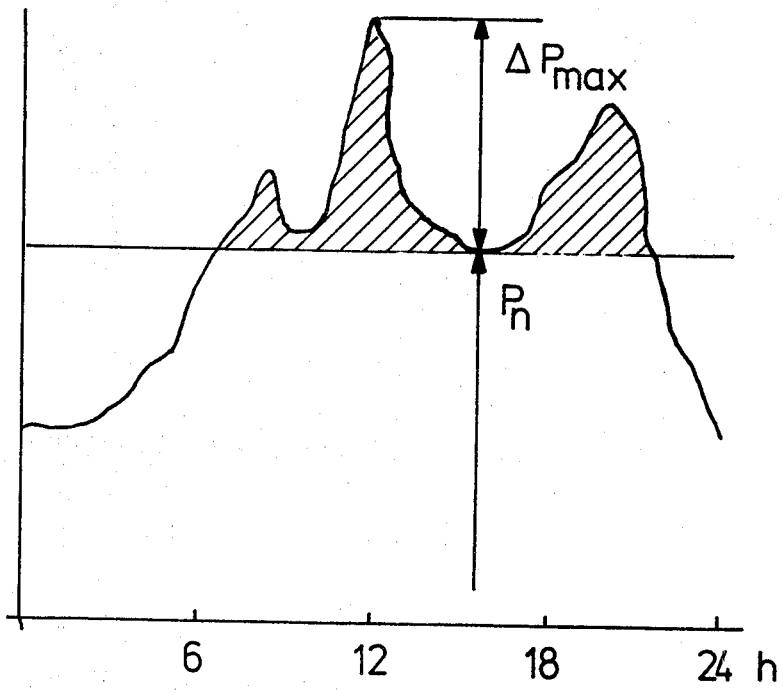
FIG. 2 is a diagram of a typical daily load curve.

The shape of the daily load curve, such as that shown in FIG. 2, is decisive for the design of the storage system. Here $P_n$ denotes the nominal output and $P_{max}$ the maximum peak output demanded, over and above $P_n$.

The size of the store 13 is determined by the work which is demanded for a load exceeding the nominal value; this work corresponds to the hatched area in the diagram.

The maximum peak output $P_{max}$ determines the design data of the peak-load turbine 16 and, according to the invention, it is provided by both the peak-load turbine 16 and by the increase in output of the main turbine 3, 3'.

As an example for illustration, the mode of action of the invention is described below on the basis of a power station with a light-water reactor, having an electrical rating of 1400 MW, and an additional demand of about 15%. The additional demand is satisfied partly by the peak-load turbine (about 80 MW) and partly by the main turbine (approxmately 130 MW) which, accordingly, has to be designed for a peak output of 1530 MW. This already shows the advantage, in that to cover a peak load of about 1610 MW, it is possible to employ a relatively low-cost reactor with a rating of only 1400 MW.

It is to be understood that it is not possible to state accurate numerical values, since the latter depend on a very large number of parameters.

In the uncharged state, the store 13 contains steam at a pressure of only about 44 bars, the pressure in the charged state originally being 60 bars. The cold condensate vessel 20 is filled with condensate at a state of 1 bar, 30° C.

If the nominal output of 1400 MW is to be provided, the main circuit can be operated without the peak circuit. In this case, a quantity of feedwater, corresponding to the quantity of water arising in the condenser 7, is delivered into the feed-heater line either via the condensate pump 8 and the line 23 or via the low-pressure feed pump 22. The condensate from the feed-heater 6 is utilized for heating the high-pressure feed-heater 12.

The process of charging the store can take place when the load is below the nominal output of 1400 MW, referred to as low load in the following text. For this purpose, the condensate, having a pressure and temperature close to that of the live steam, is passed from the reheater 6 to the store 13, causing its pressure and temperature to rise. The same quantity of water, which is withdrawn in this way from the main circuit, is made up from the cold condensate vessel 20 which slowly empties.

In the charged state, the store 13 contains water in a saturated state having approximately the pressure of the live steam, for example 60 bars, while the condensate vessel 20 is empty or is filled with water vapor.

During the discharge process with simultaneous generation of peak energy, three different modes of operation can be envisioned.

Firstly, there is what is called "normal operation" during which, depending on the design of the peak-load turbine, the amount of water delivered by the expansion vessel 15 to the feedwater tank 10 is the same as that which flows from the condenser 7 to the feedwater tank 10 under normal operating conditions of the main circuit. The store 13 is thus emptied via the throttle element 14 into the expansion vessel 15 in which a constant pressure of, for example, 10 to 12 bars is maintained.

On throttling the hot water, about 20% steam is formed and this drives the turbine 16 and is passed out into the vessel 20 after is has been condensed; the vessel is slowly filled with condensate. The remaining 80% water in the expansion vessel 15 is delivered via the line 21 to the feedwater tank 10. In this case, the pressure of this water can be somewhat higher than that prevailing in the feedwater tank 10, in order to overcome flow resistance. If, owing to the design of the plant, this were not the case, it would of course be possible to provide a pump to deliver this water. The low-pressure feed-heaters are shut off on the steam side and on the water side, that is to say the condensate from the main circuit is likewise pumped into the vessel 20.

During this normal operation, the additional output is composed of the output of the peak-load turboset according to its design (80 MW) and of the additional output of the main turbine 3, 3', resulting from closing the bleeds for low-pressure feed-heating (130 MW). The utilization of the storage capacity is extraordinarily high, of the order of 40 kWh/m$^3$, enabling dimensions of the storage vessel to be kept small.

A further mode of operation is known as "subnormal operation" in which the peak-load turbine generates only part of its design output. In this case, correspondingly less water is passed from the expansion vessel 15 to the feedwater tank 10. According to the invention, the water which the main circuit is lacking for normal operation must thus be additionally supplied via the low-pressure feed-heaters 9. Since this quantity of water is smaller than that required when the main turbine 3, 3' is operating at its design output without a store, the bleed streams of the low-pressure feed-heaters 9 are reduced. This partial relief results in an increase in the output of the main turbine 3, 3'. In this mode of operation, it is characteristic that at each load the additional output is distributed between the main set and peak set in a very clearly defined manner, that is to say they are in a definite ratio to one another which greatly simplifies control.

A third mode of operation, which is quite possible, is over-normal operation. The starting point for this is that, for a brief period, the demand for additional output is even larger than in normal operation, thus demanding that the peak-load turbine 16 be "over-sized". This mode of operation results in the water flow from the expansion vessel 15 to the feed-water tank 10 being larger than required by the main circuit, even when the low-pressure feed-heaters 9 are switched off altogether. The feedwater tank 10 must be capable of receiving this additional water and accordingly must be made larger. This enlargement, however, remains within tolerable limits since these large water flows occur only during brief periods for covering extreme peak demand.

FIG. 3 shows a circuit, by means of which the process according to the invention can be carried out without a separate peak-load turbine. The reference numerals of FIG. 1 also apply to identical parts in FIG. 3.

The steam generated by throttling in the expansion vessel 15 is passed via a line 25 into those stages of the low-pressure turbine 3', which correspond to the steam data; here it is expanded together with the steam of the main circuit. It is to be understood that in this case the low-pressure turbine must be designed to handle this additional steam.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A method of evening load fluctuations in an electrical supply network, comprising the steps of:

connecting a thermal store to a main circuit of a thermal power station;

supplying condensate from a reheater of the main circuit to the thermal store;

throttling the working medium of the thermal store to vaporize a portion of the working medium;

supplying the vaporized portion of the working medium from the thermal store to a turbine;

returning a portion of the throttled working medium in liquid form directly to a feedwater tank of the main circuit;

expanding the vaporized portion of the working medium and the steam of the main circuit;

precipitating the expanded steam in a condensor and supplying it to a condensate vessel; and interrupting a flow of working medium from the condensate vessel to a low-pressure feed-heater during the supply of the vaporized portion of the working medium from the thermal store to the turbine.

2. The method of claim 1 wherein the vaporized portion of the throttled working medium is supplied to a low pressure turbine of the main circuit of the thermal power station where it expands together with fluid of the main circuit.

3. The method of claim 1 wherein the vaporized portion of the throttled working medium expands in a peak-load turbine separate from the main circuit, is precipitated in a separate condenser and is joined to the condensate of the main circuit in the common condensate vessel.

4. Apparatus for evening load fluctuations in an electrical supply network, comprising:

storage means for storing as working medium a condensate of a reheater of a main circuit of a thermal power station;

expansion means for throttling the working medium of the storage means;

first means for supplying liquid from the expansion means to a feedwater tank of the main circuit of the thermal power plant;

second means for supplying vapor from the expansion means to a turbine;

cold condensate storage means for supplying fluid to a low-pressure feed-heater of the main circuit and for receiving condensate from the turbine; and means for selectively interrupting a flow of working medium from the cold condensate storage means of the main circuit to a low-pressure feed-heater.

5. The apparatus of claim 4 wherein the turbine is a peak-load turbine separate from the main circuit.

6. The apparatus of claim 4 wherein the turbine is a low-pressure turbine of the main circuit.

* * * * *